US011577121B2

(12) United States Patent
Hsu

(10) Patent No.: US 11,577,121 B2
(45) Date of Patent: Feb. 14, 2023

(54) TREADMILL

(71) Applicant: GEE HOO FITEC CORP., New Taipei (TW)

(72) Inventor: Ching-Lu Hsu, Taipei (TW)

(73) Assignee: GEE HOO FITEC CORP., New Taipei (TW)

( * ) Notice: Subject to any disclaimer, the term of this patent is extended or adjusted under 35 U.S.C. 154(b) by 0 days.

(21) Appl. No.: 17/236,740

(22) Filed: Apr. 21, 2021

(65) Prior Publication Data

US 2022/0134177 A1 May 5, 2022

(30) Foreign Application Priority Data

Oct. 29, 2020 (TW) ..... 109137640

(51) Int. Cl.
*A63B 22/02* (2006.01)
*A63B 71/00* (2006.01)

(52) U.S. Cl.
CPC .... *A63B 22/0235* (2013.01); *A63B 2071/009* (2013.01)

(58) Field of Classification Search
CPC ..... A63B 69/0028–0035; A63B 22/02–04
See application file for complete search history.

(56) References Cited

U.S. PATENT DOCUMENTS 5,102,380 A * 4/1992 Jacobson ..... A63B 22/02 482/111
5,372,560 A * 12/1994 Chang ..... A63B 22/0056 482/57
7,540,829 B1 * 6/2009 Chen ..... A63B 22/0235 482/54
2003/0125165 A1 * 7/2003 Trevino ..... A63B 22/0235 482/54

(Continued)

FOREIGN PATENT DOCUMENTS

CN 201316497 Y 9/2009
CN 203829555 U * 9/2014

(Continued)

OTHER PUBLICATIONS

Dong, Xu (CN 203829555 U) Machine Translation (Year: 2022).*

(Continued)

*Primary Examiner* — Nyca T Nguyen
(74) *Attorney, Agent, or Firm* — Apex Juris, PLLC; R Wylie; Tracy Heims

(57) ABSTRACT

A treadmill includes a base, a motor disposed on the base, and a motor cover. A side of the base is for disposing with a running belt. Another side of the base has a receiving space and an upper opening communicating with the receiving space. The motor is located in the receiving space for driving the running belt. A side of the motor cover is pivotally connected to the base for closing the upper opening, and another side of the motor cover is manipulable to pivot toward the side of the base disposed with the running belt to (Continued)

open the upper opening, and the motor cover is located above the running belt at this time. Thus, the user can manipulate the motor cover to open or close the upper opening without using tools, and the motor cover can be properly placed above the running belt when the upper opening is opened.

7 Claims, 7 Drawing Sheets

(56) References Cited

U.S. PATENT DOCUMENTS

2003/0134717 A1* 7/2003 Wang ..... A63B 22/02 482/54
2003/0139259 A1* 7/2003 Kuo ..... H02K 9/06 482/54
2015/0209610 A1* 7/2015 Dalebout ..... A63B 71/0622 482/54
2016/0038785 A1* 2/2016 Netter ..... A47B 21/02 482/4
2017/0128769 A1* 5/2017 Long ..... A63B 22/02

FOREIGN PATENT DOCUMENTS

CN 203899035 U * 10/2014
CN 207323943 U 5/2018
CN 209154996 U 7/2019
CN 111722719 A * 9/2020

OTHER PUBLICATIONS

Search report for TW109137640, dated Mar. 5, 2021, Total of 1 page.
English abstract for CN201316497, Total of 1 page.
English abstract for CN207323943, Total of 1 page.
English abstract for CN209154996, Total of 1 page.

* cited by examiner

TREADMILL

BACKGROUND OF THE INVENTION

Technical Field

The present invention relates generally to a treadmill, and more particularly to a motor cover of the treadmill.

Description of Related Art

A conventional treadmill usually includes a base, a motor, and a running belt disposed on the base. The motor is disposed in a receiving space of a front side of the base. The motor drives the running belt cyclically rotate so that the user can do aerobic exercises such as running or walking on the running belt. In order to prevent the user from accidentally touching the motor, to avoid dust, or to improve the overall appearance of the treadmill, a motor cover is usually disposed on treadmills on the market. The motor cover is disposed in the receiving space of the front side of the base to close an opening of the receiving space and covers above the motor.

Generally, after the treadmill has been used for a period of time, the motor cover needs to be opened to regularly clean or maintain the motor. However, the motor cover of the conventional treadmill is mostly screwed, so that the motor cover is directly fixed on the base of the treadmill through a screw. Therefore, when disassembling the motor cover, special tools are usually required to complete the work, which is inconvenient for the user to clean or maintain. In addition, when the motor cover is disassembled from the base of the treadmill, the motor cover needs to be moved to an appropriate space to prevent the motor cover from being accidentally touched which may cause damage to the motor cover. Therefore, the conventional treadmill still has room for improvement.

BRIEF SUMMARY OF THE INVENTION

In view of the above, the primary objective of the present invention is to provide a treadmill, which could facilitate a user to open or close an opening of a receiving space of a base of the treadmill and to place a motor cover of the treadmill.

The present invention provides a treadmill, including a base, a motor and a motor cover, wherein a side of the base is adapted to dispose with a running belt, and another side of the base has a receiving space and an upper opening communicating with the receiving space. The motor is disposed on the base and is located in the receiving space and is adapted to drive the running belt. A side of the motor cover is pivotally connected to the base and is adapted to close the upper opening, and another side of the motor cover is manipulable to pivot toward the side of the base disposed with the running belt to open the upper opening, wherein the motor cover is located above the running belt at this time.

In an embodiment, at least one buffering member is disposed on an outer wall of the motor cover. When the another side of the motor cover pivots to a position located above the running belt, the at least one buffering member abuts against a surface of the running belt.

In an embodiment, a first reference surface aligning with the upper opening is defined, and a second reference surface aligning with an opening of the motor cover is defined. When the another side of the motor cover pivots to a position located above the running belt, an included angle between the first reference surface and the second reference surface is greater than or equal to 90 degrees.

In an embodiment, when the another side of the motor cover pivots to a position located above the running belt, an included angle between the first reference surface and the second reference surface is greater than or equal to 90 degrees and smaller than or equal to 150 degrees.

In an embodiment, the treadmill includes a linking member disposed in the receiving space and located adjacent to the running belt, wherein the linking member is pivotally connected to the base and the motor cover respectively.

In an embodiment, the linking member includes two linking rods, wherein an end of each of the linking rods is pivotally connected to the base respectively, and another end of each of the linking rods is pivotally connected to two lateral sides of the motor cover respectively.

In an embodiment, the linking member includes a crossbar, wherein each of two ends of the crossbar is fixed on one of the linking rods.

In an embodiment, the linking member has two protrusions respectively located on one of the linking rods. The motor cover has two stoppers, wherein each of the stoppers is disposed on one of the two lateral sides of the motor cover. When the motor cover pivots relative to the linking member toward the side of the base disposed with the running belt, each of the protrusions abuts against one of the stoppers to restrict a pivoting angle of the motor cover relative to the linking member.

In an embodiment, the treadmill includes a restricting member disposed in the receiving space, wherein when the motor cover is located at a position that the motor cover closes the upper opening, the motor cover is movable by a horizontal force in a direction away from the running belt to drive the linking member to swing to a position that the linking member abuts against the restricting member, and the motor cover is pushed by the linking member to be elevated relative to the base.

In an embodiment, the linking member has at least one protrusion. The motor cover has at least one stopper. When the motor cover pivots relative to the linking member toward the side of the base disposed with the running belt, the at least one protrusion of the linking member abuts against the at least one stopper of the motor cover to restrict a pivoting angle of the motor cover relative to the linking member.

With the aforementioned design, by pivotally connecting the side of the motor cover to the base, the user could manipulate the motor cover to open or close the upper opening without using tools, facilitating the user to easily repair or maintain the motor. In addition, when the motor cover is manipulated to open the upper opening, the motor cover pivots toward the side of the base disposed with the running belt, so that the motor cover could be properly placed on the running belt, improving the disadvantage of inconveniently storing and placing the motor cover when disassembling the motor cover from the base of the conventional treadmill.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

A treadmill 1 according to an embodiment of the present invention is illustrated in FIG. 1 to FIG. 7 and includes a base 10, a motor 20, and a motor cover 30.

Figure 1:
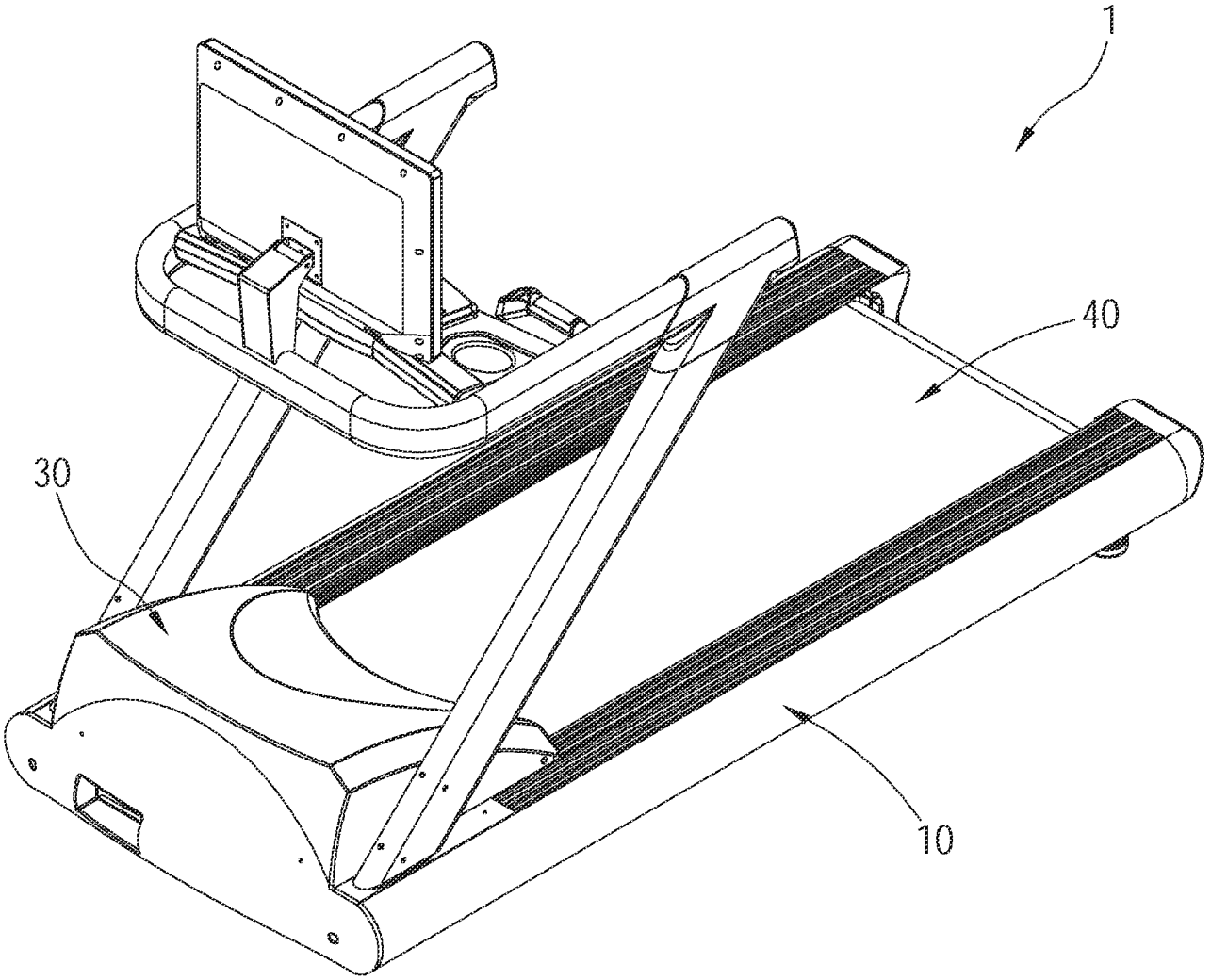
FIG. 1 is a perspective view of the treadmill according to an embodiment of the present invention.
Figure 2:
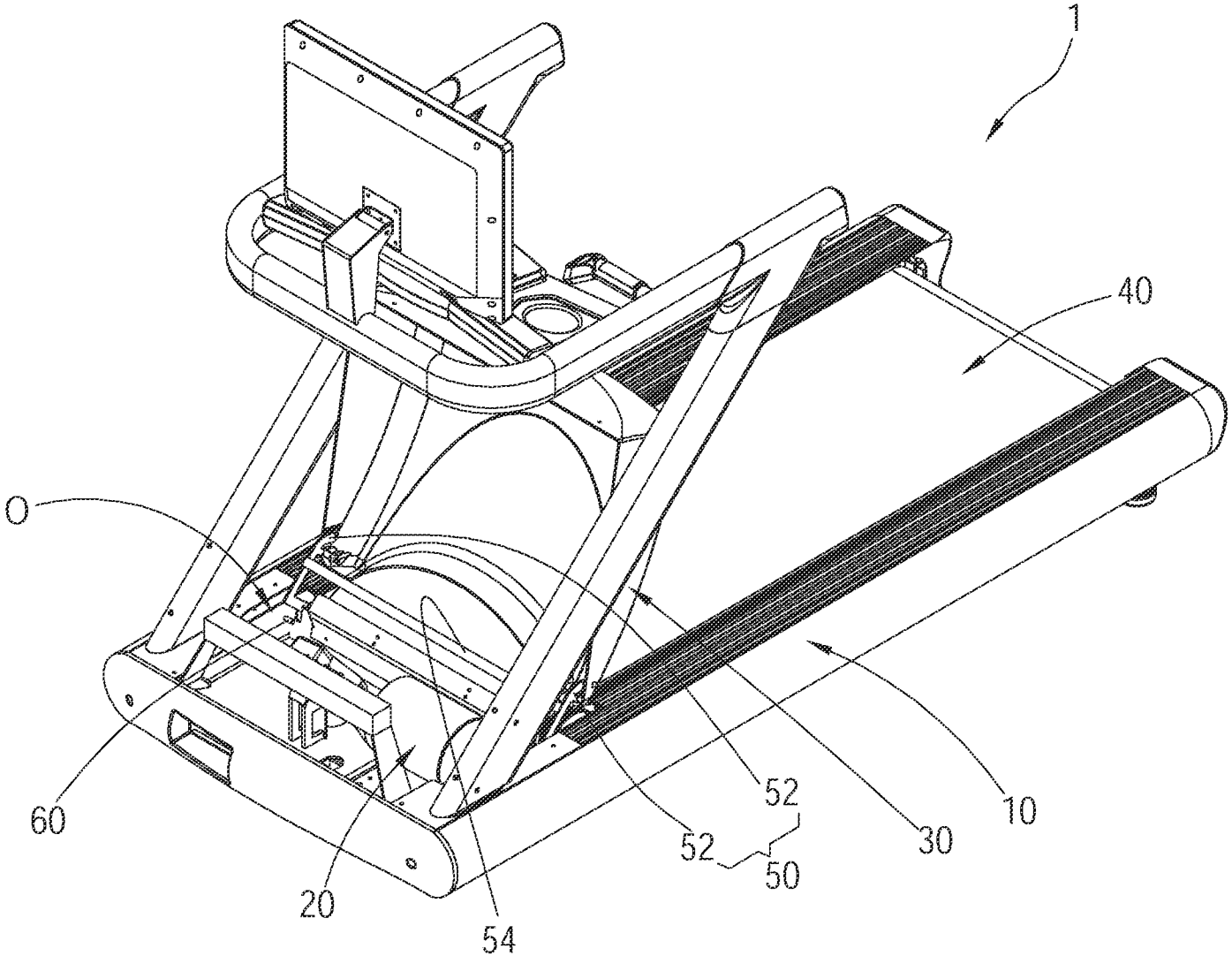
FIG. 2 is a perspective view, showing the opening of the motor cover is in the open state.

As shown, a running belt 40 is disposed on a side of the base 10. Another side of the base 10 which is opposite to the side disposed with the running belt 40 has a receiving space S and an upper opening O communicating with the receiving space S. The motor 20 is disposed on the base 10 and is located in the receiving space S and is adapted to drive the running belt 40 cyclically rotate so that a user could do aerobic exercises such as running or walking on the running belt 40. As shown in FIG. 1 and FIG. 2, a side of the motor cover 30 is pivotally connected to the base 10 and is adapted to close the upper opening O, and another side of the motor cover 30, which is opposite to the side of the motor cover 30 connected to the base 10, is manipulable to pivot toward the side of the base 10 disposed with the running belt 40, so as to open the upper opening O, wherein the motor cover 30 is located above the running belt 40 at this time. In this way, the motor cover 30 could be properly placed above the running belt 40, improving the disadvantage of inconveniently storing and placing the motor cover when disassembling the motor cover from the base of the conventional treadmill. In addition, the user could manipulate the motor cover 30 to open or close the upper opening O without using tools, facilitating the user to easily repair or maintain the motor 20.

Figure 3:
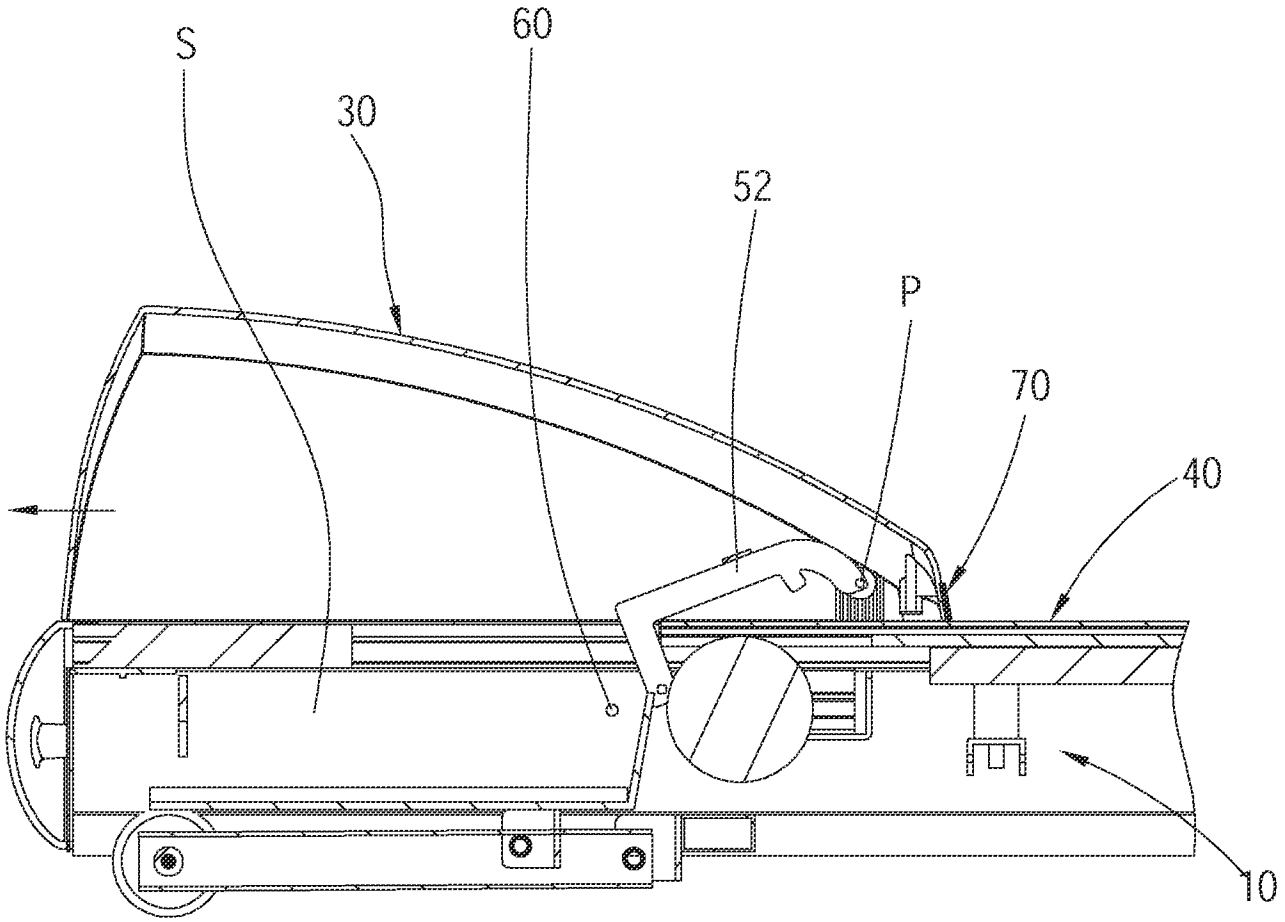
FIG. 3 is a partially side view, showing the motor cover closes the upper opening of the base.
Figure 4:
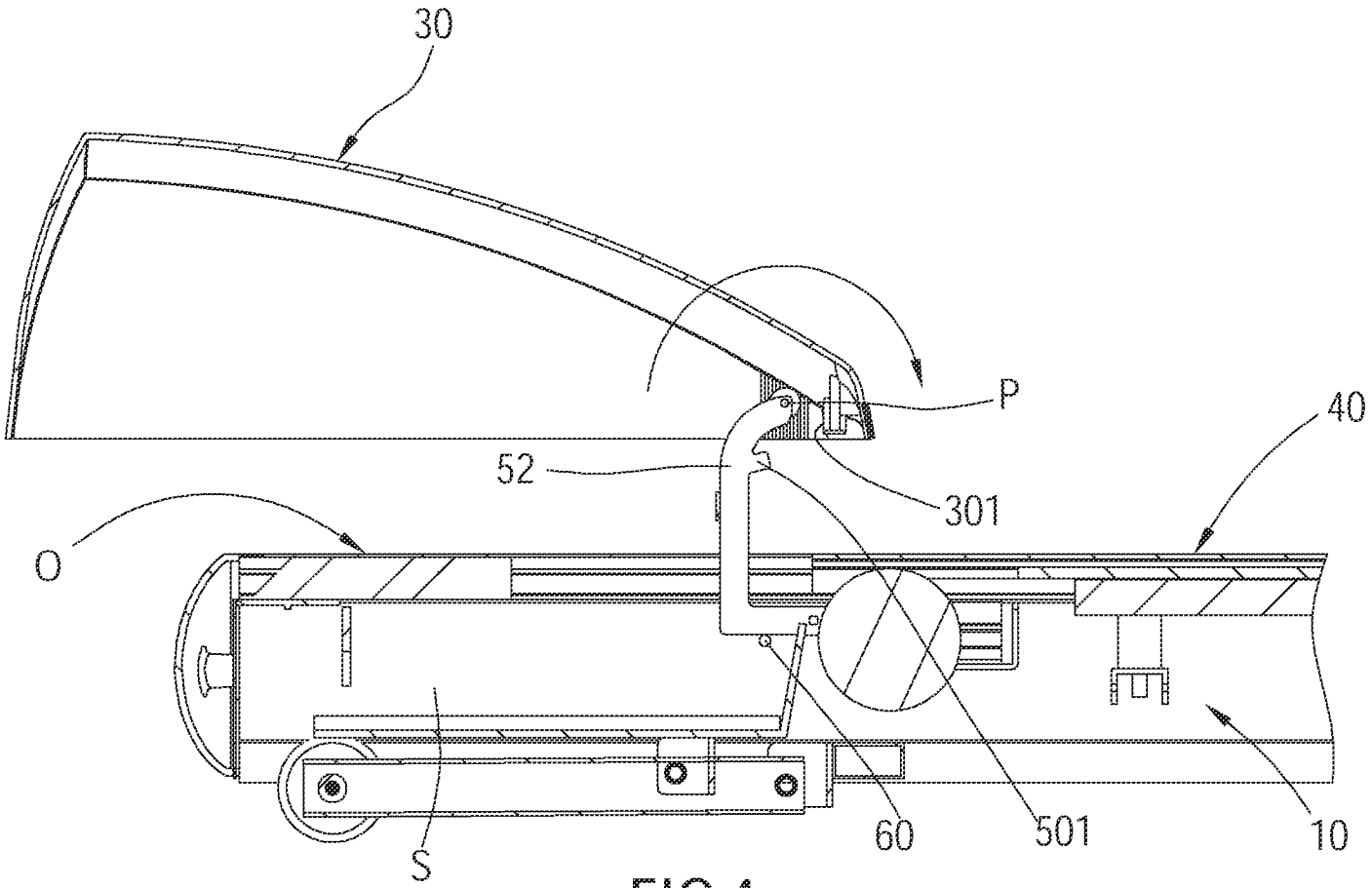
FIG. 4 is a partially side view, showing the motor cover is pushed by the linking rods of the supporting member to be elevated relative to the base.

In addition, the treadmill 1 includes a linking member 50 and a restricting member which are disposed in the receiving space S, wherein the linking member 50 is located adjacent to the running belt 40 and is pivotally connected to the base 10 and the motor cover 30 respectively. In the current embodiment, the linking member 50 includes two linking rods 52, wherein an end of each of the linking rods 52 is pivotally connected to the base 10 respectively, and another end of each of the linking rods 52 is pivotally connected to one of two lateral sides of the motor cover 30. The restricting member includes two restricting rods 60 corresponding to the linking rods 52 and respectively disposed on an inner wall of two lateral sides of the receiving space S. As shown in FIG. 3, when the motor cover 30 is pulled by a horizontal force parallel to the running belt 40 in a direction away from the running belt 40, the motor cover 30 drives the linking rods 52 of the linking member 50 to swing in a direction away from the running belt 40 to a position that the linking rods 52 of the linking member 50 abut against the restricting rods 60 of the restricting member (as shown in FIG. 4), and the motor cover 30 is pushed by the linking rods 52 of the linking member 50 to be elevated relative to the base 10. In the current embodiment, the linking member 50 further includes a crossbar 54, wherein two ends of the crossbar 54 are respectively fixed on one of the linking rods 52 (as shown in FIG. 2). In this way, the two lateral sides of the motor cover 30 could move simultaneously through the linking rods 52.

Figure 5:
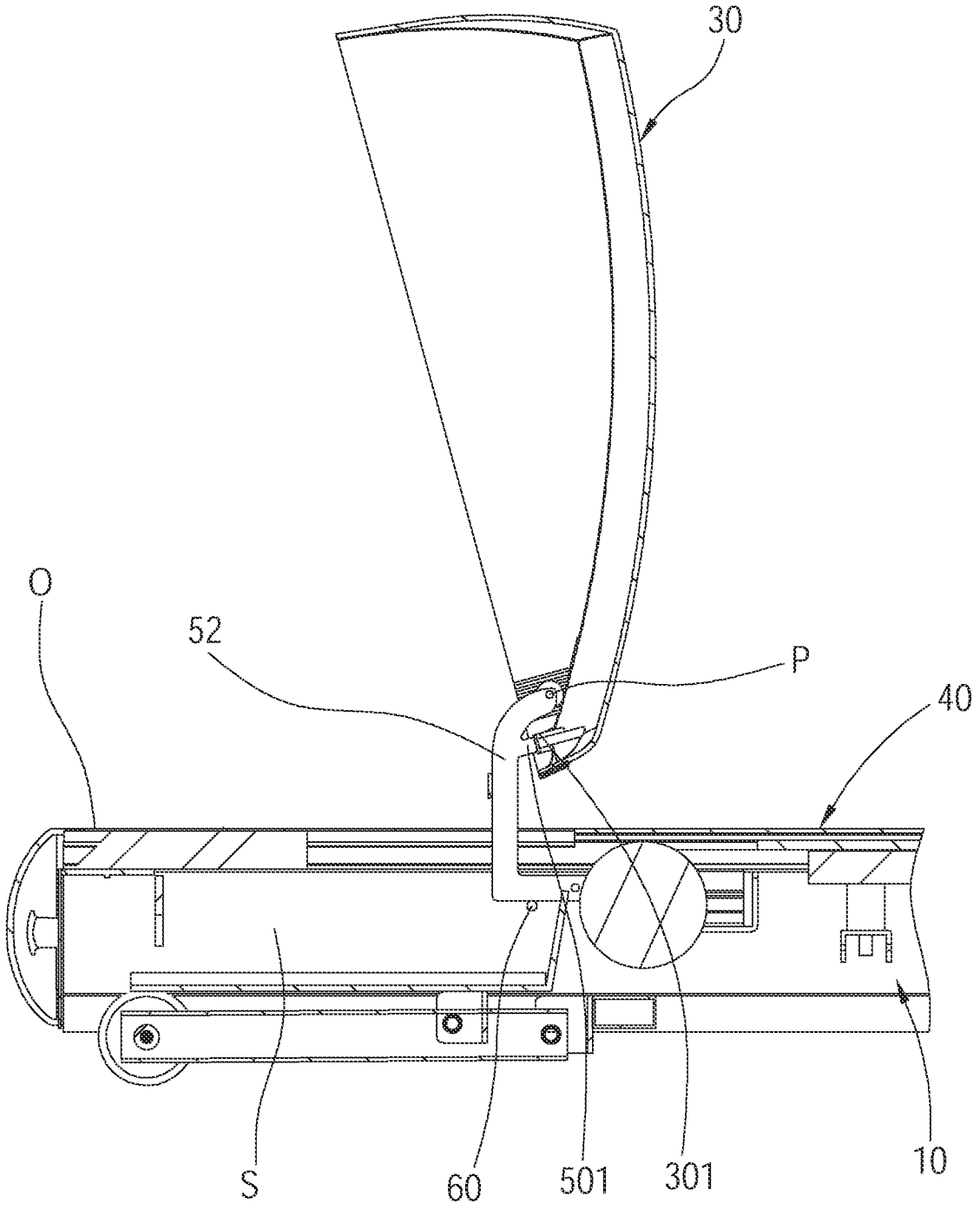
FIG. 5 is a partially side view, showing each of the stoppers of the motor cover abuts against one of the protrusions of the supporting member.
Figure 6:
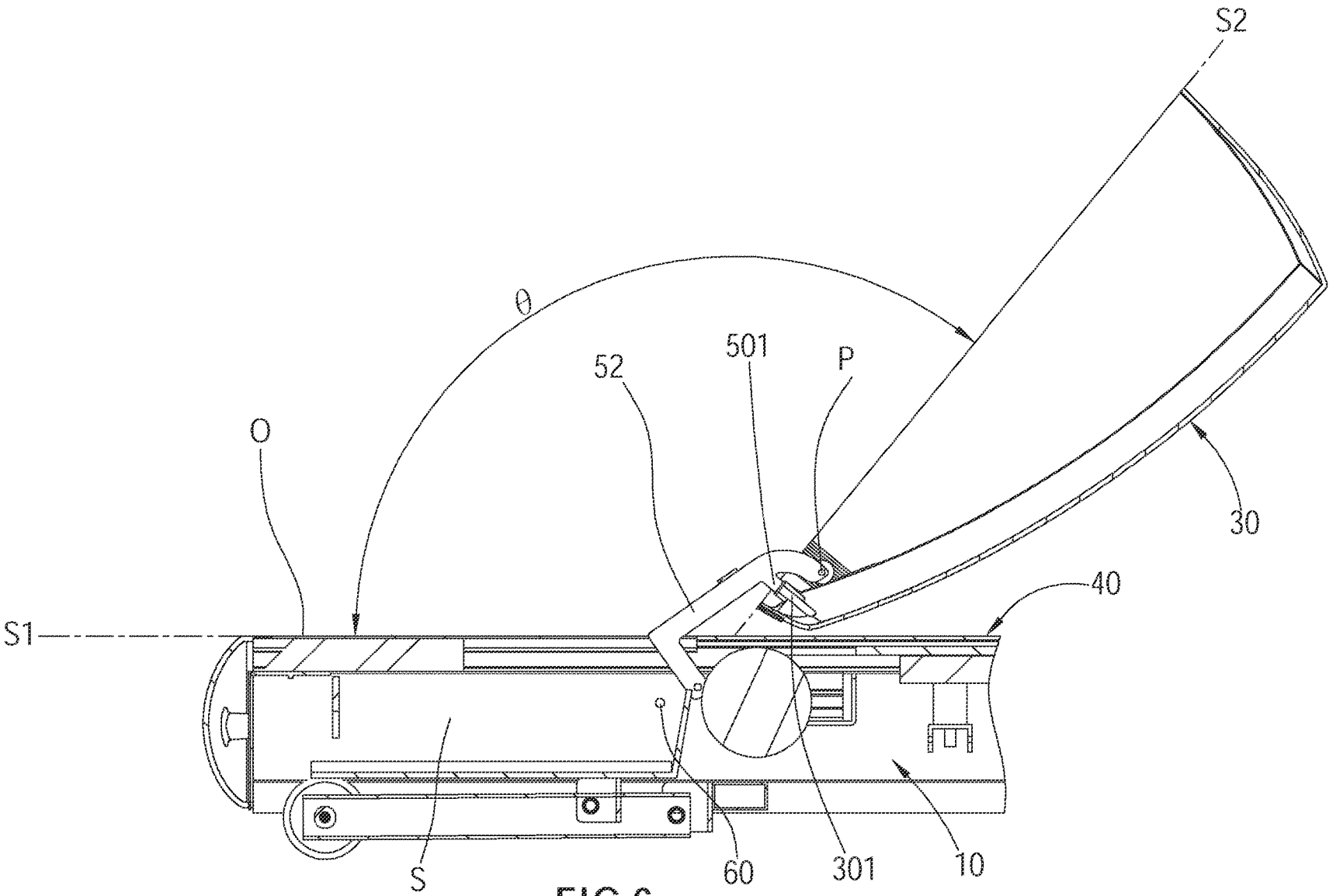
FIG. 6 is a partially side view, showing the maximum pivoting angle of the motor cover.
Figure 7:
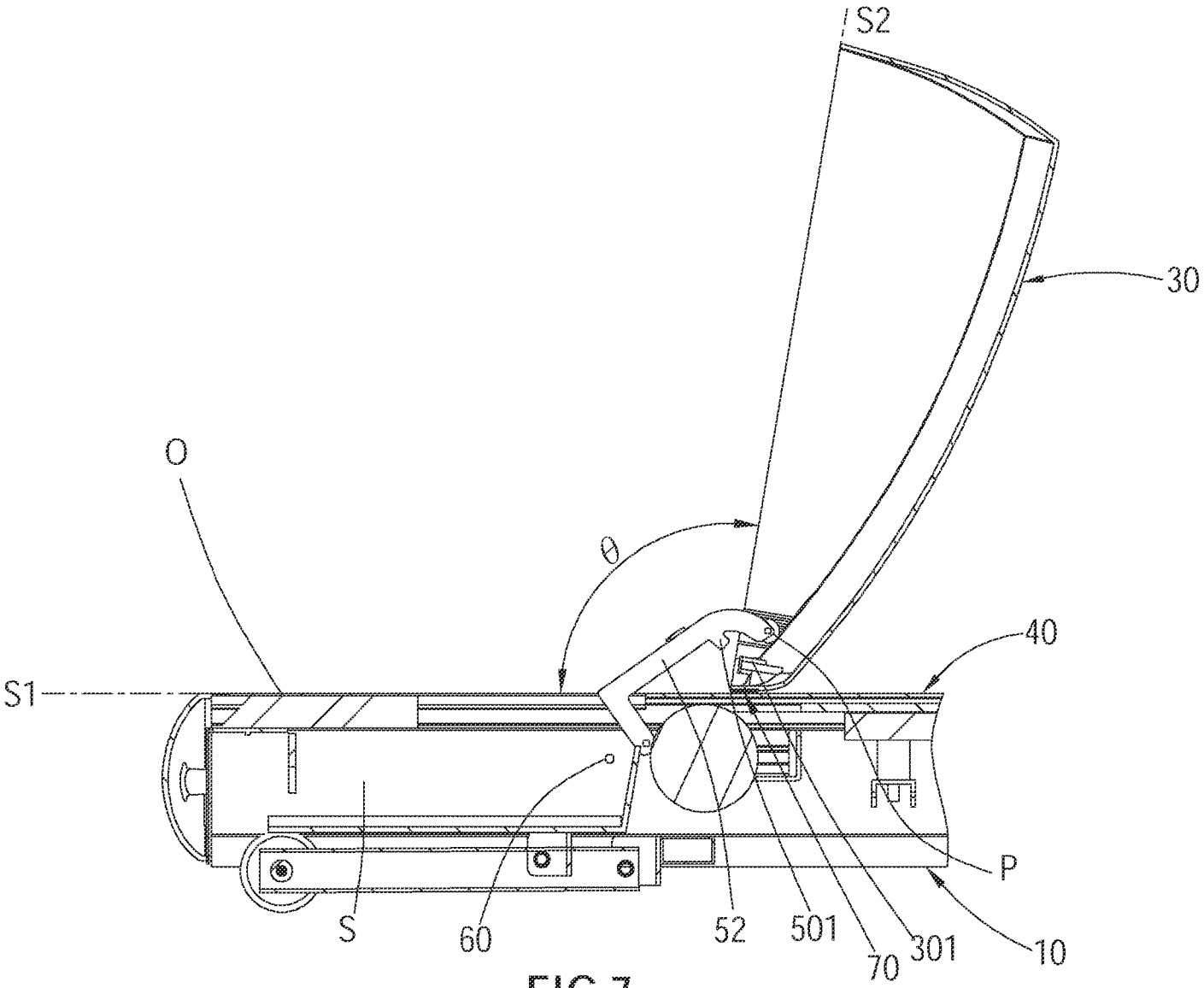
FIG. 7 is a partial side view, showing the buffering members abutting against the surface of the running belt when the motor cover is located above the running belt.

The linking member 50 has two protrusions 501 respectively located on one of the linking rods 52. The motor cover 30 has two stoppers 301 disposed on the two lateral sides of the motor cover 30 respectively. When the motor cover 30 pivots relative to the linking member 50 toward the side of the base 10 disposed with the running belt 40, each of the protrusions 501 abuts against one of the stoppers 301 to restrict a pivoting angle of the motor cover 30 that the motor cover pivots relative to the linking member 50. For example, when the motor cover 30 is pulled by the horizontal force which is parallel to the running belt 40 in the direction away from the running belt 40 to drive the linking rods 52 of the linking member 50 to swing in the direction away from the running belt 40 to the position that the linking rods 52 of the linking member 50 abut against the restricting rods 60 of the restricting member as shown in FIG. 4, the motor cover 30 could pivot around a connecting site P between the motor cover 30 and the linking rods 52 of the linking member 50 toward the side of the base 10 disposed with the running belt 40 until each of the stoppers 301 of the motor cover 30 abuts against one of the protrusions 501 of the linking member 50 (as shown in FIG. 5). As shown in FIG. 6, when each of the protrusions 501 abuts against one of the stoppers 301 of the motor cover 30, and the user continues to pivot the motor cover 30 toward the side of the base 10 disposed with the running belt 40, the linking rods 52 of the linking member 50 swing accordingly to leave the restricting rods 60 of the restricting member. After that, as shown in FIG. 7, the motor cover 30 could be slightly pivoted away from the side of the base 10 disposed with the running belt 40 around the connecting site P, so that each of the stoppers 301 of the motor cover 30 leaves one of the protrusions 501 of the linking member 50, and a case of the motor cover 30 abut against the running belt 40. In this way, the motor cover 30 could be properly placed above the running belt 40, improving the disadvantage of inconveniently storing and placing the motor cover when disassembling the motor cover from the base of the conventional treadmill. In the current embodiment, a number of the protrusions 501 of the linking member 50 is two as an example, and a number of the stoppers 301 of the motor cover 30 is two as an example. In other embodiments, the number of the protrusions of the linking member and the number of the stoppers of the motor cover could be respectively one or more than two, as long as the protrusions could correspond to the stoppers.

In contrast, when a user is about to close the upper opening O of the base 10 with the motor cover 30, the user could pivot the motor cover 30 and the linking member 50 in the direction away from the running belt 40 to swing the linking rods 52 of the linking member 50 to the position that the linking rods 52 of the linking member 50 abut against the restricting rods 60 of the restricting member as shown in FIG. 5. After that, the user could pivot the motor cover 30 around the connecting site P toward the side of the base 10 having the receiving space S (as shown in FIG. 4). Then, the user could push the motor cover 30 by providing a horizontal force which is parallel to the running belt 40 in the direction toward the running belt 40, thereby to return the motor cover 30 to a position where the motor cover 30 close the upper opening O of the base 10 (as shown in FIG. 3).

Additionally, a buffering member 70 is disposed on each of two sides of an outer wall of the motor cover 30. When the another side of the motor cover 30 pivots to a position located above the running belt 40 as shown in FIG. 7, each of the buffering members 70 abuts against a surface of the running belt 40. In this way, when the case of the motor cover 30 abuts against the running belt 40, each of the buffering members 70 could provide a buffering effect to prevent the motor cover 30 and the running belt 40 from directly colliding with each other and causing damage to the motor cover 30, wherein each of the buffering members 70 could be, but not limited to, a rubber pad or a silicone pad.

It is worth mentioning that, in the current embodiment, a first reference surface S1 aligning with the upper opening O is defined (i.e., the upper opening O is on the first reference surface S1), and a second reference surface S2 aligning with an opening of the motor cover 30 is defined. When the motor cover 30 pivots to a position above the running belt 40, an included angle θ between the first reference surface S1 and the second reference surface S2 is greater than or equal to 90 degrees, as shown in FIG. 6 and FIG. 7. Preferably, the included angle θ between the first reference surface S1 and the second reference surface S2 is greater than or equal to 90 degrees and smaller than or equal to 150 degrees. The included angle θ shown in FIG. 6 is a maximum pivoting angle of the motor cover 30. In the current embodiment, the maximum pivoting angle of the motor cover 30 is 120 degrees. In this way, the setting of the included angle θ could facilitate the user to easily repair or maintain the motor 20.

In summary, by pivotally connecting the side of the motor cover 30 to the base 10, the user could manipulate the motor cover 30 to open or close the upper opening O without using tools, facilitating the user to easily repair or maintain the motor 20. In addition, when the motor cover 30 is manipulated to open the upper opening O, the motor cover 30 pivots toward the side of the base 10 disposed with the running belt 40, so that the motor cover 30 could be properly placed on the running belt 40, improving the disadvantage of inconveniently storing and placing the motor cover when disassembling the motor cover from the base of the conventional treadmill.

It must be pointed out that the embodiments described above are only some preferred embodiments of the present invention. All equivalent structures which employ the concepts disclosed in this specification and the appended claims should fall within the scope of the present invention.

What is claimed is:

1. A treadmill, comprising:

a base, wherein a side of the base is adapted to dispose with a running belt, and another side of the base has a receiving space and an upper opening communicating with the receiving space;

a motor disposed on the base and located in the receiving space, wherein the motor is adapted to drive the running belt;

a motor cover, wherein a side of the motor cover is pivotally connected to the base and is adapted to close the upper opening, and another side of the motor cover is manipulable to pivot toward the side of the base disposed with the running belt to open the upper opening, wherein the motor cover is located above the running belt when the upper opening is open and a linking member disposed in the receiving space and located adjacent to the running belt, wherein the linking member is pivotally connected to the base and the motor cover respectively;

wherein at least one buffering member is disposed on an outer wall of the motor cover; when the another side of the motor cover pivots to a position located above the running belt, the at least one buffering member abuts against a surface of the running belt.

2. The treadmill as claimed in claim 1, wherein a first reference surface aligning with the upper opening is defined, and a second reference surface aligning with an opening of the motor cover is defined; when the another side of the motor cover pivots to a position located above the running belt, an included angle between the first reference surface and the second reference surface is greater than or equal to 90 degrees.

3. The treadmill as claimed in claim 2, wherein the included angle between the first reference surface and the second reference surface is greater than or equal to 90 degrees and smaller than or equal to 150 degrees.

4. The treadmill as claimed in claim 1, further comprising a restricting member disposed in the receiving space, wherein when the motor cover is located at a position that the motor cover closes the upper opening, the motor cover is movable by a horizontal force in a direction away from the running belt to drive the linking member to swing to a position that the linking member abuts against the restricting member, and the motor cover is pushed by the linking member to be elevated relative to the base.

5. A treadmill, comprising:

a base, wherein a side of the base is adapted to dispose with a running belt, and another side of the base has a receiving space and an upper opening communicating with the receiving space;

a motor disposed on the base and located in the receiving space, wherein the motor is adapted to drive the running belt;

a motor cover, wherein a side of the motor cover is pivotally connected to the base and is adapted to close the upper opening, and another side of the motor cover is manipulable to pivot toward the side of the base disposed with the running belt to open the upper opening, wherein the motor cover is located above the running belt when the upper opening is open; and a linking member disposed in the receiving space and located adjacent to the running belt, wherein the linking member is pivotally connected to the base and the motor cover respectively;

wherein the linking member comprises two linking rods; an end of each of the linking rods is pivotally connected to the base respectively, and another end of each of the linking rods is pivotally connected to two lateral sides of the motor cover respectively;

wherein the linking member comprises a crossbar; and each of two ends of the crossbar is fixed on one of the linking rods.

6. The treadmill as claimed in claim 5, wherein the linking member has two protrusions respectively located on one of the linking rods; the motor cover has two stoppers; each of the stoppers is disposed on one of the two lateral sides of the motor cover; when the motor cover pivots relative to the linking member toward the side of the base disposed with the running belt, each of the protrusions abuts against one of the stoppers to restrict a pivoting angle of the motor cover relative to the linking member.

7. A treadmill, comprising:

a base, wherein a side of the base is adapted to dispose with a running belt, and another side of the base has a receiving space and an upper opening communicating with the receiving space;

a motor disposed on the base and located in the receiving space, wherein the motor is adapted to drive the running belt;

a motor cover, wherein a side of the motor cover is pivotally connected to the base and is adapted to close the upper opening, and another side of the motor cover is manipulable to pivot toward the side of the base disposed with the running belt to open the upper opening, wherein the motor cover is located above the running belt when the upper opening is open; and a linking member disposed in the receiving space and located adjacent to the running belt, wherein the linking member is pivotally connected to the base and the motor cover respectively; wherein the linking member has at least one protrusion; the motor cover has at least one stopper; when the motor cover pivots relative to the linking member toward the side of the base disposed with the running belt, the at least one protrusion of the linking member abuts against the at least one stopper of the motor cover to restrict a pivoting angle of the motor cover relative to the linking member.

* * * * *